US007762835B2

(12) United States Patent
Peters et al.

(10) Patent No.: US 7,762,835 B2
(45) Date of Patent: Jul. 27, 2010

(54) ELECTRICAL CONTACT CONNECTING TO A CONDUCTING LEAD EMBEDDED IN A PIECE OF FOIL

(75) Inventors: Paulus M. G. M. Peters, Duiven (NL); Jozef M. T. Lenssen, Arnhem (NL); Auke G. Talma, Bathmen (NL)

(73) Assignee: Helianthos B.V., Arnhem (NL)

( * ) Notice: Subject to any disclaimer, the term of this patent is extended or adjusted under 35 U.S.C. 154(b) by 63 days.

(21) Appl. No.: 11/887,266

(22) PCT Filed: Mar. 24, 2006

(86) PCT No.: PCT/EP2006/061033

§ 371 (c)(1),
(2), (4) Date: Nov. 15, 2007

(87) PCT Pub. No.: WO2006/103204

PCT Pub. Date: Oct. 5, 2006

(65) Prior Publication Data

US 2009/0011635 A1 Jan. 8, 2009

Related U.S. Application Data

(60) Provisional application No. 60/671,457, filed on Apr. 15, 2005.

(30) Foreign Application Priority Data

Mar. 30, 2005 (EP) ..... 05075735

(51) Int. Cl.
*H01R 12/24* (2006.01)

(52) U.S. Cl. ..... 439/499

(58) Field of Classification Search ..... 439/499, 439/620.21, 578, 404, 494, 352
See application file for complete search history.

(56) References Cited

U.S. PATENT DOCUMENTS 3,033,970 A * 5/1962 Eisler ..... 219/549
3,235,833 A * 2/1966 Elm ..... 439/411
4,225,205 A * 9/1980 Sinclair et al. ..... 439/467

(Continued)

FOREIGN PATENT DOCUMENTS

EP 1 117 153 A2 7/2001

(Continued)

*Primary Examiner*—T C Patel
*Assistant Examiner*—Phuong Nguyen
(74) *Attorney, Agent, or Firm*—Oliff & Berridge, PLC

(57) ABSTRACT

A connector housing assembly comprises a foil, an upper connector housing part having a lower face that faces an upper surface of the foil and a lower connector housing part having an upper face that faces a lower surface of the foil. The lower face of the upper connector housing part or the upper face of the lower connector housing part has an opening forming a recess that accommodates at least a part of a connector contact and the foil. At least one of the upper connector housing part or the lower connector housing part has at least one protruding component and each protruding component is inserted through a respective hole in the foil. The upper connector housing part and the lower connector housing part are drawn to each other by the protruding component which engages a holding means that abuts a surface thus exerting a retention force.

14 Claims, 4 Drawing Sheets

U.S. PATENT DOCUMENTS 4,374,605 A * 2/1983 Bratt ..... 439/578
5,310,362 A * 5/1994 Bauerle et al. ..... 439/620.21
6,254,428 B1 * 7/2001 Murakami et al. ..... 439/556
6,568,955 B2 5/2003 Hotea et al.
6,666,706 B1 12/2003 Jones et al.
7,354,305 B2 * 4/2008 Sundstrom ..... 439/505
2002/0092666 A1 7/2002 Hasegawa et al.

FOREIGN PATENT DOCUMENTS

WO WO 01/78156 A1 10/2001

* cited by examiner

ELECTRICAL CONTACT CONNECTING TO A CONDUCTING LEAD EMBEDDED IN A PIECE OF FOIL

BACKGROUND

The invention relates to a connector housing assembly for accommodating a connector contact for use in connecting a wire to a conducting lead embedded in a piece of foil, comprising at least one connector housing part, wherein at least one connector housing part comprises a recess for accommodating at least part of the connector contact, a face of the connector housing part facing a surface of the piece of foil being provided with an opening of the recess, wherein at least one connector housing part includes at least one protruding component, protruding from a face of that connector housing part facing a surface of the piece of foil, in use, each of the protruding component(s) being adapted to insertion through a respective hole in a piece of foil adjacent to the face from which it protrudes.

The invention also relates to a method of attaching a connector for use in connecting a wire to a conducting lead embedded in a piece of foil to the foil, including attaching to the foil a connector contact having a terminal for use in connecting a wire to the conducting lead, providing a connector housing assembly including at least a connector housing part comprising a recess for accommodating at least part of the connector contact, a face of the connector housing part facing a surface of the piece of foil being provided with an opening of the recess, inserting at least one protruding component protruding from a face in a connector housing part facing a surface of the piece of foil, through a respective hole in the piece of foil, and bringing the face of the connector housing part provided with the recess opening towards the facing surface of the piece of foil.

The invention also relates to an assembly of such a connector housing assembly and a housing for a mating connector.

Respective examples of such assemblies and such a method are known. U.S. Pat. No. 6,568,955 discloses an electrical connector which at least partially receives a foil with printed conductors embedded therein, and comprises an insulating housing with an insertion aperture for the foil and at least one foil contact with a contact section for contacting the printed conductors. For introduction of the foil, an actuator, pivotally mounted at a hinge, is opened. Retaining webs, which are formed on the actuator, penetrate the foil to guard against the tensile force exerted on the foil. Locking noses of the housing engage in apertures and fix the actuator in the final assembled position.

SUMMARY

A problem of the known connector housing assembly is that it can only be used in conjunction with relatively narrowly shaped pieces of foil, or pieces of foil having a ribbon-shaped section with the conducting lead embedded in it extending from an edge. This limits the range of application of such a connector.

It is an object of the invention to provide a connector housing assembly, method of attaching a connector and assembly as defined in the opening paragraphs which ensure that the connector housing stays attached to the foil independently of the connector contact, find use with a broader range of foil shapes and afford more flexibility in placement of the connector.

This object is achieved by means of the connector housing assembly according to the invention, which is characterised in that the connector housing assembly is configured to enable a retention force drawing the face of the connector housing part provided with the recess opening towards the facing surface of the piece of foil to be exerted through at least one of the protruding components.

Because the retention force can be exerted through at least one of the protruding components inserted through a hole in the piece of foil, the connector housing assembly need not envelop the piece of foil to as many sides. Thus, use of the connector housing assembly is not confined to those pieces of foil provided with elongate protruding ribbons with an embedded conducting lead. Similarly, the connector housing assembly can be placed at, or near an edge of the piece of foil running parallel to the conducting lead. Because the retention force can be exerted through the protruding component, the connection between the connector contact and piece of foil is not relied on to also hold the connector housing assembly and the piece of foil together. Thus, independence of connection is achieved, preventing stresses on the embedded conducting lead.

In a preferred embodiment, the recess is comprised in a first of two connector housing parts, at least one of the two connector housing parts is constituted by one of the at least one connector housing parts including at least one protruding component, and the other of the two connector housing parts is provided with at least one opening for receiving a protruding component inserted through a hole in the piece of foil and protruding towards a face of the other connector housing part facing a surface of the piece of foil, and is configured to enable a retention force drawing the two connector housing parts towards each other to be exerted through at least one of the received protruding components.

Because the other of the two connector housing parts is provided with at least one opening for receiving a protruding component inserted through a hole in the piece of foil and protruding towards a face of the other connector housing part facing a surface of the piece of foil, the two connector housing parts can be situated facing opposite surfaces of the piece of foil. The protruding component inserted through the hole in the piece of foil connects the two together. One of the two connector housing parts is the connector housing part comprising the recess for accommodating at least part of the connector contact. Because the connector housing part receiving a protruding component is configured to enable a retention force drawing the two connector housing parts towards each other to be exerted through the at least one received protruding component, the connector housing part comprising the recess is held close to or against the piece of foil. No separate latches or devices bypassing the piece of foil are needed. This means that the two connector housing parts can be situated anywhere in the plane of the piece of foil. In particular, placement of the connector is not limited to positions close to the edge.

In a preferred variant of this embodiment, at least one of the two connector housing parts is provided with a face opposite the face facing a surface of the piece of foil, in use, which opposite face is substantially planar and parallel to the surface of the piece of foil, at least when that connector housing part has been drawn sufficiently towards the piece of foil.

This variant is of particular use when applied to accommodate a connector contact for use in connecting a wire to a conducting lead in a piece of foil that further comprises active elements interacting with the environment through the surface of the piece of foil. This includes pieces of foil with solar elements in particular, but also pieces of foil with light-emitting elements. Because the opposite face is substantially planar and parallel to the surface of the piece of foil, shadows or image artefacts depending on the angle of radiation relative to the piece of foil are prevented.

In a variant of the same embodiment, at least one of the two connector housing parts is provided with a recess having an opening in the face of that connector housing part facing a surface of the piece of foil, in use, and a face opposite the face facing a surface of the piece of foil, in use, wherein the distance between the opposite faces has a value smaller than two times a depth of the recess as measured from the opening.

Thus, at least one of the connector housing parts is substantially flat, with a minimum possible height. This variant is also of particular use when applied to pieces of foil that further comprise active elements interacting with the environment through the surface of the piece of foil. In this variant the occurrence of shadow forms and/or obstructions of any kind is prevented to a relatively large extent.

In an embodiment of the connector housing assembly, the recess is comprised in a first of two connector housing parts, and the second of the two connector housing parts comprises a second recess for accommodating at least one part of an accommodated connector contact protruding from a surface of the foil facing, in use, a face of the second connector housing part provided with an opening of the second recess.

Thus, when the two connector housing parts are placed on either side of the piece of foil, at least part of the connector contact is accommodated in the first recess of the first connector housing part. Where the connector contact pierces the piece of foil, so that at least one part protrudes from the surface of the piece of foil, that at least one part is effectively shielded from environmental influences. The same holds true for any components embedded in the piece of foil that might be exposed to the environment due to the piercing of the piece of foil by the connector contact.

In an embodiment of the connector housing assembly, at least one face of a connector housing part provided with a recess opening is configured to engage sealing means, adapted to abut against the facing surface of the piece of foil over an area of contact substantially surrounding the recess opening when the face of the connector housing part is drawn sufficiently towards the facing surface of the piece of foil.

The sealing means can be an integral part of the face of the connector housing part or a separate component. Examples in the latter category include sealing rings, and or rings of sealant applied to the face of the connector housing part. This embodiment allows for more effective shielding of the connector contact from the environment. It helps to prevent corrosion due to water creeping in between the connector housing part and the surface of the piece of foil. An additional advantage is that any embedded parts of the piece of foil that are exposed by the act of fixing the connector contact to the conducting lead are also shielded.

In an embodiment of the connector housing assembly according to the invention, at least one of the protruding components is formed integrally with the connector housing part in which it is included.

This embodiment has the advantage of being easy to manufacture and assembly, particular where final assembly occurs at a site remote from the initial production location. Fewer parts such as bolts or rivets are required.

In an embodiment of the connector housing assembly, the connector housing part comprising the recess includes a portion providing an enclosure for accommodating a terminal of an accommodated connector contact, the enclosure being open to the recess near one end of a longitudinal axis of the enclosure and providing external access from a direction parallel to the longitudinal axis at an opposite end, wherein the longitudinal axis is oriented transversely to the face of the connector housing part facing the surface of the piece of foil, in use.

Thus, in use, the wire connected to the embedded conducting lead by means of the connector contact, is placed at an angle to the plane of the piece of foil. This embodiment finds a useful application in cases where the piece of foil is to be applied to a backing member for stability. The backing member can be kept relatively flat, with only a small interruption to provide a passage for the wire and/or portion of the connector housing part providing an enclosures for accommodating the terminal. This is especially true where the longitudinal axis is substantially perpendicular to the face of the connector housing part facing the surface of the piece of foil, in use.

In a variant of this embodiment, at least one of the connector housing parts is adapted to engage a housing of a mating connector terminating a wire to be connected to a conducting lead embedded in the piece of foil.

When the housing of the mating connector is engaged, the end of the enclosure for accommodating a terminal that provides external access is closed off better. As the enclosure for accommodating a terminal is open to the recess near one end of a longitudinal axis of the enclosure, this helps keep the recess shielded from external influences such as moisture.

In a further development of the latter-mentioned variant, the connector housing assembly comprises retention means for maintaining engagement with the housing of the mating connector.

Thus, inadvertent disconnection is prevented. Stress relief is provided to the wire, in particular pull relief, to which end the retention means can be specially adapted. This embodiment finds practical use in connecting a wire to a piece of foil placed at an angle to the direction of gravitation. In particular, the wire can be left suspended with relatively little additional supporting means.

According to another aspect, the method according to the invention is characterised by bringing at least one of the inserted protruding components into engagement, on a side of the piece of foil opposite the connector housing part provided with that protruding component, with holding means adapted to exert a retention force drawing the face of the connector housing part provided with the recess opening towards the facing surface of the piece of foil.

Because the connector housing part comprising the recess is drawn towards the surface of the piece of foil such that the face facing that surface and provided with the recess opening is brought into close proximity, the site of connection of the connector contact to the foil is shielded relatively well. At least one protruding component inserted through a hole in the foil is used to exert the force keeping that connector housing part in close proximity. Therefore, little or no reliance need be placed for this purpose on latches or mechanisms situated next to edges of the piece of foil. This provides greater flexibility in terms of the locations at which the connector can be situated and the shapes of the pieces of foil with which it can be used.

In an embodiment of the method, at least one protruding component is inserted through a hole in the conducting lead embedded in the piece of foil.

This embodiment is advantageous when used in conjunction with pieces of foil with embedded active elements for interaction with the environment through a surface on at least one side of the piece of foil. The connector housing parts cover relatively little of the surface area through which the interaction takes place.

An embodiment of the method includes providing a further connector housing part, having an elongated profile, wherein at least one of the two connector housing parts is provided with at least one opening for receiving a protruding component protruding from a face of the other connector housing part facing a surface of the foil and inserted through a hole in the piece of foil, further including positioning the further connector housing part over the conducting lead with a longitudinal axis of the further connector housing part substantially in parallel to the conducting lead.

This embodiment is also advantageous when used in conjunction with pieces of foil with embedded active elements for interaction with the environment through a surface on at least one side of the piece of foil. The further connector housing part with the elongated profile is advantageously placed on that side of the piece of foil on which the interaction takes place. It then covers relatively little of the parts of the surface through which this interaction takes place.

In an embodiment of the invention, the provided connector housing assembly comprises a connector housing assembly according to the invention.

According to another aspect of the invention, there is provided an assembly comprising a connector housing assembly and a housing for a mating connector, wherein the connector housing assembly comprises a connector housing assembly according to an embodiment of the invention.

BRIEF DESCRIPTION OF THE DRAWINGS

The invention will now be explained in further detail with reference to the accompanying drawings, in which.

DETAILED DESCRIPTION OF EMBODIMENTS

Figure 1:
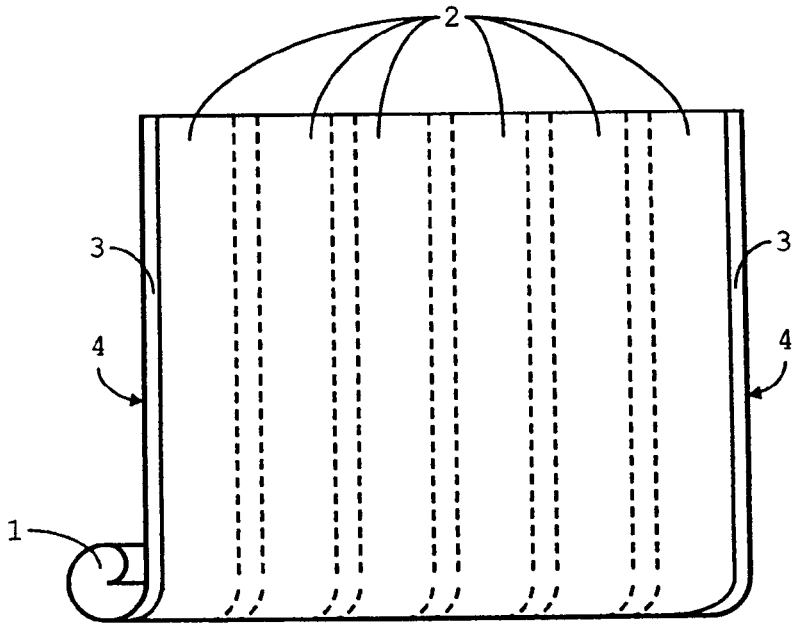
FIG. 1 is a schematic illustration of a roll of solar foil from which a piece may be cut to form an assembly with connector contacts for attachment to wires.

In FIG. 1 a roll 1 of photovoltaic (PV) foil comprises a plurality of solar cells 2, arranged in an array. Each row comprises a number of solar cells 2 connected in series by means of interconnects (not detailed separately in FIG. 1). Two bus bars 3 are embedded in the foil. An example of a method of manufacturing the roll 1 of foil is set out in more detail in WO 01/78156. An example of a roll 1 of foil that is currently manufactured has a width of about 1.2 m.

Thin film solar cell foils, also known as photovoltaic foils, generally comprise a carrier and a photovoltaic layer composed of a semiconductor material provided between a front electrode comprising a transparent conductive oxide (TCO) at the front of the foil and a back electrode at the back of the foil. The front electrode is transparent, enabling incident light to reach the semiconductor material, where the incident radiation is converted into electric energy. In this way, light is usable to generate electric current.

Manufacturing the solar foil on the roll 1 has the advantage that pieces, or strips, can be cut off to provide a unit for generating a desired voltage or power. It is preferred to allow pieces of any length to be cut off to form a unit. To make this possible, the roll 1 preferably has no pre-defined division into units. This means that it should be possible to provide a point of connection to the wires that are to be attached to conduct the generated electric current at substantially any position along the length of the roll 1 of foil.

In the shown configuration, the solar cells 2 are series-connected between the bus bars 3. The length of the piece of foil that is cut off from the roll 1 determines the length of each bus bar 3 in the foil. The width of a bus bar 3 (in the plane of the foil) is preferably a value in the range of 0.5 1 cm. The height is preferably a value in the range of 80 100 μm. A suitable material for the bus bars 3 is aluminium, although another electrically conductive material, e.g. a metal or metal alloy is usable in alternative embodiments.

Not only is it desirable to allow the provision of a point of connection to wires at substantially any position along the length of the roll 1 of foil, this position should also be at a relatively large distance from edges oriented in the longitudinal direction. When a unit is cut from the roll 1 and laminated between layers of insulating foil for application to a surface, the bus bar 3 is located some way from the edges of the laminated foil. This is due to the mandatory presence of an electrically insulating border along each of the edges 4, which border extends from the edges 4 to the parallel edges of the laminated foil.

Figure 2:
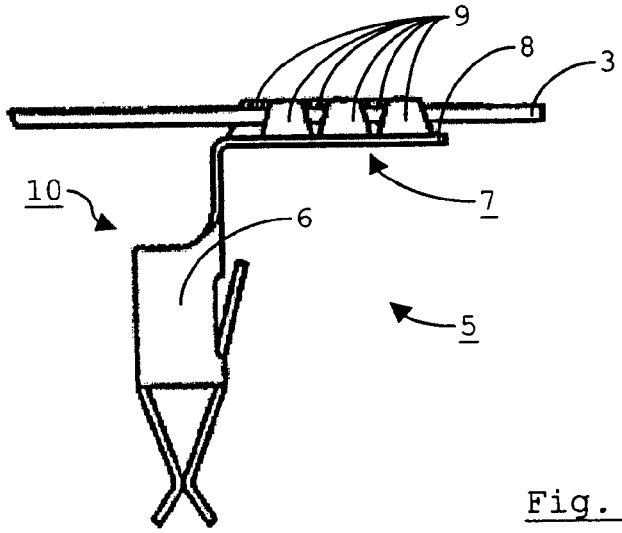
FIG. 2 is a side view, in partial cross-section, of a connector contact crimped to a conducting lead embedded in a piece of foil.

A connector contact 5 for use in connecting a wire (not shown) to one of the bus bars 3 is shown in FIG. 2. It is shown subsequent to attachment to a piece of foil cut from the roll of foil 1. The connector contact 5 comprises a terminal 6 for use in connecting a wire to the bus bar 3. In the shown embodiment, the connector contact 5 is a single, integral component. The connector contact 5 is known as such from applications in the automotive field. It is obtainable by stamping and subsequent shaping steps. Embodiments made of copper, aluminium and alloys thereof are usable. Such embodiments are optionally coated, for example galvanised. Preferably, the connector contact is made of galvanised phosphor bronze, to facilitate its being crimp connected to the piece of foil.

The connector contact 5 includes a first section 7, including a substantially planar base 8, from which six tines 9 protrude. These tines 9 form contact elements for establishing an electrically conductive connection to the bus bar 3 at a desired point along its length. The first section 7 is of a somewhat elongated shape, and is attached to a second section 10 at one longitudinal end. The opposite longitudinal end terminates the connector contact 5. The second section 10 includes the (female) terminal 6. The terminal 6 is suitable for mating with a male terminal (not shown) of a wire connector. In an alternative embodiment, the second section 10 includes a terminal for direct attachment to a wire, for example by soldering or crimping onto the wire.

It is noted that the second section 10 is oriented transversely to the substantially planar base 8. As shown, its longitudinal axis is substantially perpendicular to the planar base 8. Because the planar base is brought into abutment with a surface of the piece of foil, it is parallel to the plane of the foil. Preferably, the connector contact 5 is connected to a rear surface of the piece of foil, opposite a surface through which radiation is incident on the piece of foil. This rear surface is preferably supported, in use on a backing surface, provided with a small passage for the connector contact 5 and a connector housing part in which it is accommodated.

When the connector contact 5 is attached, the tines 9 are pressed through the piece of foil and folded back. The folded back portions of the tines 9 therefore protrude from a surface of the piece of foil opposite the surface against which the planar base 8 abuts. In the embodiments illustrated herein, a connector housing assembly is provided that includes a connector housing part shielding the protruding parts of the tines 9, as will be explained in more detail below.

Figure 3:
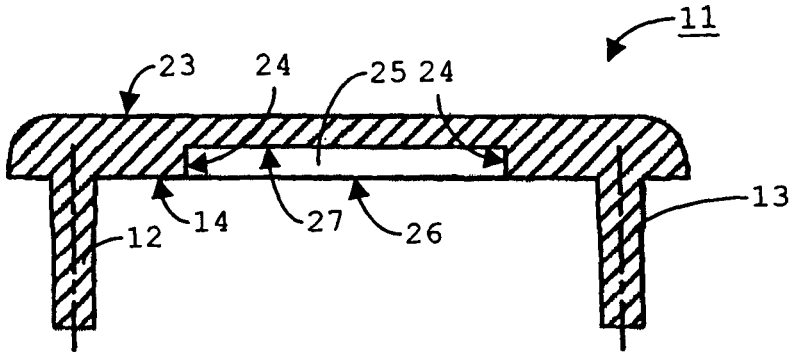
FIG. 3 is a cross-sectional side view of an upper connector housing part in a first embodiment of a connector housing assembly.
Figure 4:
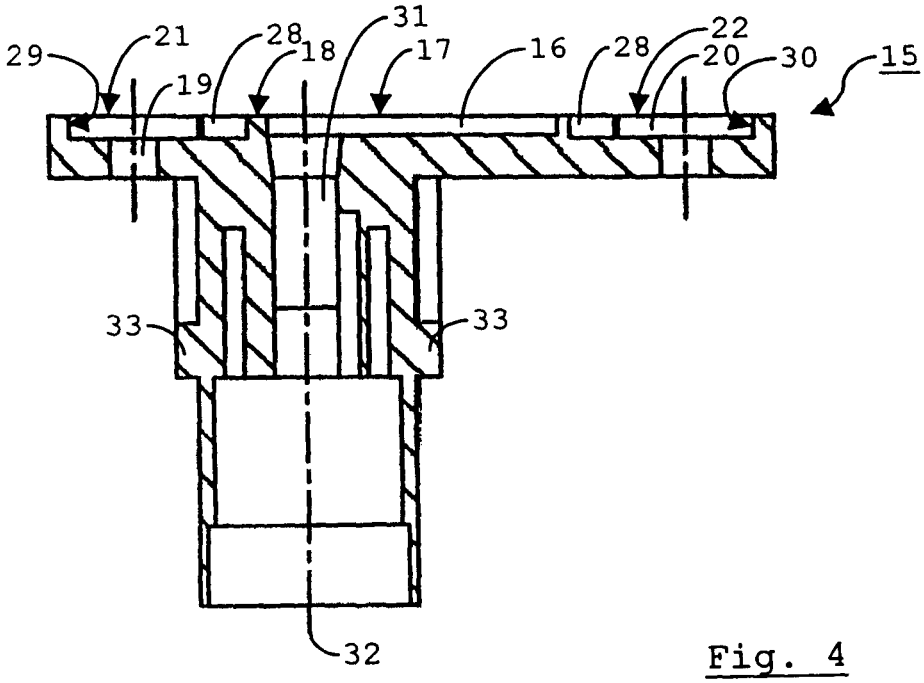
FIG. 4 is a cross-sectional side view of a lower connector housing part in the embodiment of a connector housing assembly illustrated in FIG. 3.

A first embodiment of a connector housing assembly is illustrated in FIGS. 3 and 4. An upper connector housing part 11 includes two pins 12, 13. The pins 12, 13 protrude from a lower face 14 of the upper connector housing part 11. In use, the lower face 14 faces the upper surface of the piece of foil to which the connector comprising the connector housing assembly is attached. The upper connector housing part 11 shields the parts of the tines 9 protruding from the upper surface of the piece of foil. It also shields any components embedded in the piece of foil that would otherwise be exposed to the elements due to the face that the tines 9 have ruptured the upper surface. Furthermore, the upper connector housing part 11 serves to enable a retention force keeping a lower connector housing part 15 (FIG. 4) in close proximity to a lower surface of the piece of foil to be exerted. The retention force is exerted through the first and second pins 12, 13 protruding from the lower face 14.

In the present description, the term face is used in its geometrical sense, to denote the surface of a three-dimensional object as regarded or approached from a particular direction. Bar any protruding components protruding from the lower face 14 that serve to conduct the retention force, the lower face 14 of the upper connector housing part 11 is substantially level with respect to a plane perpendicular to the direction in which the retention force is exerted.

The lower connector housing part 15 comprises a main recess 16 for accommodating the second section 10 of the connector contact 5. An opening 17 of the main recess 15 is provided in an upper face 18 of the lower connector housing part 16. In use, the upper face 18 faces a lower surface of the piece of foil to which the connector housing parts 11, 15 are attached.

Figure 10:
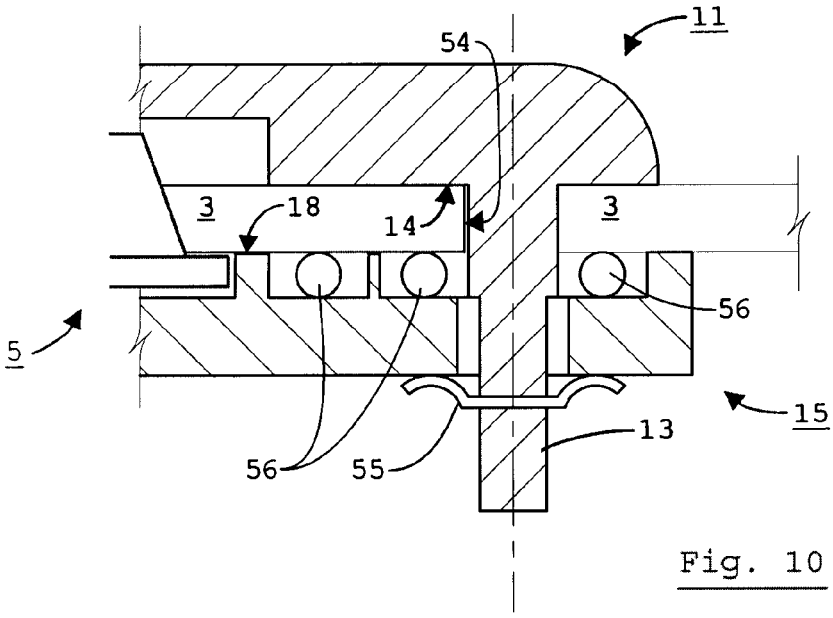
FIG. 10 is a cross-sectional side view of an upper connector housing part and a lower connector housing part assembled together.

To bring about this attachment, the pins 12, 13 protruding from the lower face 14 are inserted through respective holes 54 in the piece of foil from the top. They are received in respective first and second passages 19,20. To this end, the first and second passages 19,20 have openings 21,22 respectively, provided in the upper face 17 of the lower connector housing part 15. The lower face 14 and upper face 18 are drawn towards the upper and lower surface of the piece of foil interposed between them. When the lower face 14 and upper face 18 are sufficiently close to the facing upper and lower surfaces of the interposed piece of foil, the pins 12, and 13 protrude from ends of the passages 19,20 opposite the openings 21,22. The protruding parts of the pins 12 and 13 are brought into engagement with holding means 55 adapted to exert a retention force, as shown in FIG. 10. The retention force keeps the first and second connector housing parts in close proximity to the foil. Holding means 55 engaging the pins 12,13 abut part of a surface of the lower connector housing part surrounding the exits of the passages 19,20 on an opposite side to the openings 21,22.

Examples of holding means 55 include tie-wraps and steel-locks. In an alternative embodiment, the passages 19,20 comprise at least a part that is threaded and the pins 12,13 are likewise provided with screw thread. Resilient clamping means are, however, preferred, as the upper and lower connector housing parts 11,15 are preferably made of plastic, with the pins 12, 13 being formed integrally with the upper connector housing part 11. In principle, it is also possible to melt the parts of the pins 12, 13 protruding from the passages 19,20. The elasticity of the material of the pins 12, 13 then provides the retention force. Flared out ends of the pins 12, 13 created by melting are to be regarded as holding means 55.

In an alternative embodiment, the pins 12,13 are included in the lower connector housing part 11. Thus, they protrude from the upper face 18, in which the opening of the main recess 16 also lies. In a first variant, the connector housing assembly includes only holding means 55 on the side of the piece of foil from which the pins 12, 13 protrude when inserted through holes 54 in the foil. This is useful if the upper surface of the foil is left intact when the connector contact is attached. In another variant, the upper connector housing part 11 is provided with the passages 19, 20 and openings 21,22. Alternatively, each of the upper and lower connector housing parts 11,15 could include one of the pins 12, 13, with the other being provided with one of the openings 21,22 for receiving the pins 12,13 protruding towards it from the upper or lower surface of the foil, depending on which surface it faces.

Returning to the embodiment illustrated in FIGS. 3 and 4, the upper connector housing part 11 is provided with an upper face 23, opposite the lower face 14 facing the upper surface of the piece of foil, in use. The upper face 23 is substantially planar, except for its rounded edges. It is also substantially level. After the upper connector housing part 11 has been brought in sufficient proximity to the upper surface of the piece of foil, the upper connector housing part 11 is substantially parallel to the upper surface of the piece of foil. What constitutes a sufficient proximity is determined by the precise embodiment of the upper connector housing part 11. As shown in FIG. 10, the lower face 14 should be closer to the upper surface of the foil than a certain distance. Parallel orientation is achieved at least when the lower face 14 is in closest possible proximity to the foil. In one embodiment, the lower face 14 can be brought into abutment. In another embodiment, sealing means 56 positioned between the upper connector housing part 11 and the foil determine the final distance between the lower face 14 and the upper surface of the foil.

Such sealing means 56 can, for example, be provided along edges 24 of a secondary recess 25 comprised in the upper connector housing part 11. The secondary recess 25 is configured to accommodate the parts of the tines 9 that protrude from the upper surface of the foil. It also covers the area surrounding the protruding parts. Especially when the above-mentioned sealing means 56 are provided around the edges 24, the fact that the tines 9 rupture the upper surface of the foil does not therefore result in significant exposure of components embedded in the foil. To these ends, the lower face 14—the face opposite the upper surface of the foil, in use—is provided with an opening 26 of the secondary recess 25.

A number of measures are provided to lessen the impact of the upper connector housing part 11 on the ability of the foil to absorb incoming radiation in the solar cells 2.

Firstly, the height of the upper connector housing part 11 is kept as low as possible. In this case, the height refers to the distance from the lower face 14 to the, opposite, upper face 23. It is preferably smaller than two times the depth of the secondary recess 25 as measured from the opening 26 to an opposite inner wall 27 of the secondary recess 25.

Secondly, in a preferred manner of attachment of the connector to the foil, the pins 12, 13 are inserted through holes 54 punched through the bus bar 3. In a practical embodiment, the bus bar 3 has a width in the plane of the foil with a value in the range of 0.5 to 1 cm. The diameter of the holes 54 that are punched is preferably kept lower than 80% of the width of the bus bar 3 embedded in the foil.

Thirdly, as is apparent amongst others from FIG. 3, the upper connector housing part 11 has an elongated profile. It has an elongated profile when viewed from a direction perpendicular to the lower face 14 or upper face 23, due to its low height. It also has an elongated profile when viewed from at least one direction perpendicular to the direction perpendicular to the lower face 14. Because both pins 12, 13 are preferably inserted through holes 54 punched through the bus bar 3, the longitudinal axis of the upper connector housing part 11 is automatically positioned substantially in parallel to the bus bar 3. Thus, a relatively large part of the upper connector housing part 11 covers the bus bar 3 in use, rather than any of the solar cells 2.

Further aspects of the lower connector housing part 15 are most visible in FIG. 4. The upper face 18 of the lower connector housing part 15 is advantageously configured to engage sealing means 56 to ensure continuous contact with the foil along an area of contact substantially completely surrounding the opening 17. In the shown embodiment, these sealing means 56 can be provided in a circumferential groove 28 and/or along edges 29,30 of the openings 21,22 for receiving the protruding pins 12,13. Alternatively, ridges formed as an integral part of the body of the lower connector housing part 15 are engaged as sealing means 56. Such ridges must be shaped and finished so as to abut against a lower surface of the foil over an area of contact substantially completely surrounding the opening 17 when the upper face 18 is sufficiently drawn towards the lower surface of the foil. Sufficient implies that the distance between the upper face 18 and lower surface of the foil is smaller than a certain minimum, which is the minimum distance needed to ensure proper contact.

The second section 10 including the terminal 6 of the connector contact 5 is accommodated in a cylindrical enclosure 31. The enclosure 31 is open to the main recess 16 at an upper end of a longitudinal axis 32. External access to a connector contact of a mating connector is provided at a lower end. It is noted that the longitudinal axis 32 is oriented substantially at right angles to the upper face 18 of the lower connector housing part 15.

Retention barbs 33 are provided as part of a locking mechanism for engaging the housing of a mating connector, as will be explained in more detail below.

Figure 5:
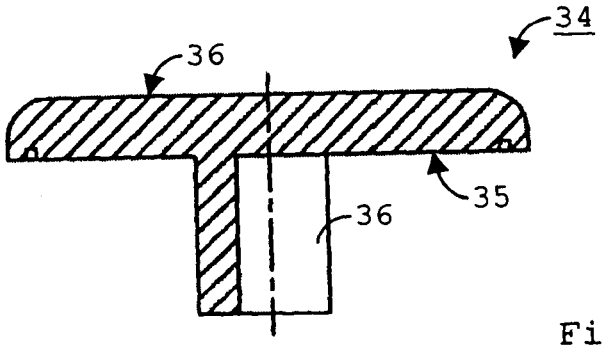
FIG. 5 is a cross-sectional side view of an upper connector housing part in a second embodiment of a connector housing assembly.
Figure 8:
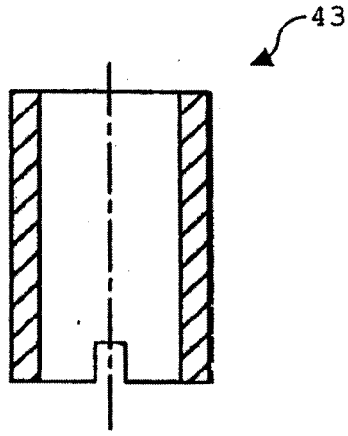
FIG. 8 is a cross-sectional side view of a bush comprised in the second embodiment of a connector housing assembly.

FIGS. 5 8 relate to an alternative connector housing assembly. It shares most of the features of the connector housing assembly discussed hereinbefore. The discussion below will be limited to repeating pertinent features and discussing the differences between the two assemblies. Reference is made to the preceding discussion for further details.

An upper connector housing part 34 is provided for placement over the upper surface of a piece of solar foil. In use, a lower face 35 faces the upper surface of the piece of foil. An upper face 36 is turned in the opposite direction. The lower and upper faces 35,36 are substantially planar and parallel. The height of the upper connector housing part 34—the distance between the lower and upper faces 35,36—is such as to give the upper connector housing part 34 an elongated profile, as in the case of the upper connector housing part 11 of FIGS. 3 4.

A protrusion 37 is formed integrally with the upper connector housing part 34 and protrudes from the lower face 35. In use, the protrusion 37 is inserted through a hole 54 in the piece of foil, just like the pins 12,13 of the embodiment shown in FIGS. 3 4. The same measures are used to ensure that the upper connector housing part 34 covers as little of the surface area over the solar cells 2 as possible.

Figure 6:
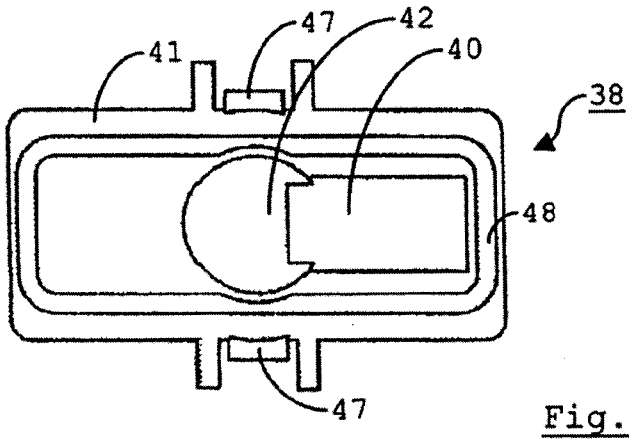
FIG. 6 is a top view of a face of a lower connector housing part of the second embodiment, which face faces a surface of a piece of foil, in use.
Figure 7:
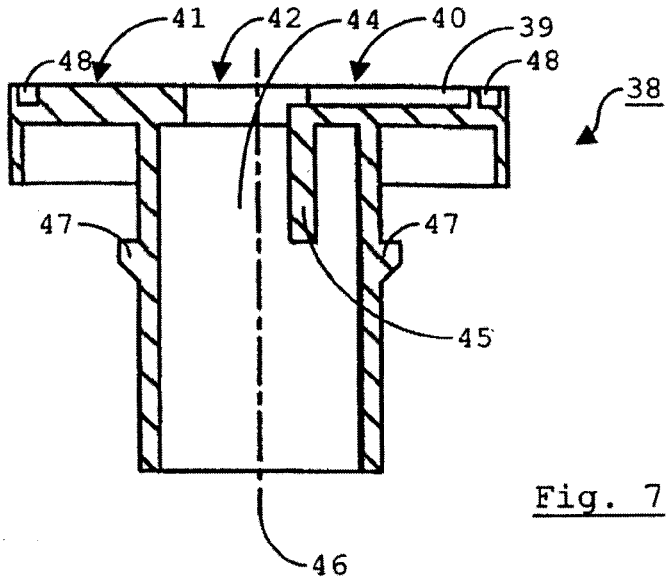
FIG. 7 is a cross-sectional side view of the connector housing part shown in FIG. 6.

A lower connector housing part 38 is shown in FIGS. 6 7. It comprises a main recess 39 for accommodating the first section 7 of the connector contact 5. An opening 40 of the recess 39 is provided in an upper face 41 of the lower connector housing part 38. The upper face 41 is turned to face a lower surface of the foil, in use. The protrusion 37 of the upper connector housing part 34 is received in an opening 42 extending the opening 40, and similarly provided in the upper face 41. A bush 43 (FIG. 8) is received in the lower connector housing part 38. Screw thread (not shown in detail) provided on the protrusion 37 and bush 43 enable attachment of the upper connector housing part 34 to the lower connector housing part 38. Screwing the parts together ensures that the upper and lower connector housing parts 34,38 are drawn towards each other, clamping a piece of foil situated between the upper face 41 and lower face 35.

When the protrusion 37 is received in the lower connector housing part 38, it defines an enclosure at a location indicated with reference numeral 44, together with a downwardly extending wall section 45. A longitudinal axis 46 of the enclosure is substantially perpendicular to the upper face 41. The enclosure provides external access to the terminal 6 at an end opposite the opening 42 in the upper face 41. The lower connector housing part 38 is adapted to engage a mating connector provided with a suitable male contact terminal. To maintain engagement, a locking mechanism is used. Barbs 47 are comprised in this locking mechanism.

A groove 48 is provided in the upper face 41 to engage sealing means 56. The sealing means 56 (FIG. 10) abut against the lower surface of the foil when the upper and lower connector housing parts 34,38 are screwed together. The groove 48 completely surrounds both the opening 40 of the main recess 39 and the opening 42 for receiving the protrusion 37. Thus, the sealing of the main recess 39 and the enclosure accommodating the terminal 5 is enhanced.

Figure 9:
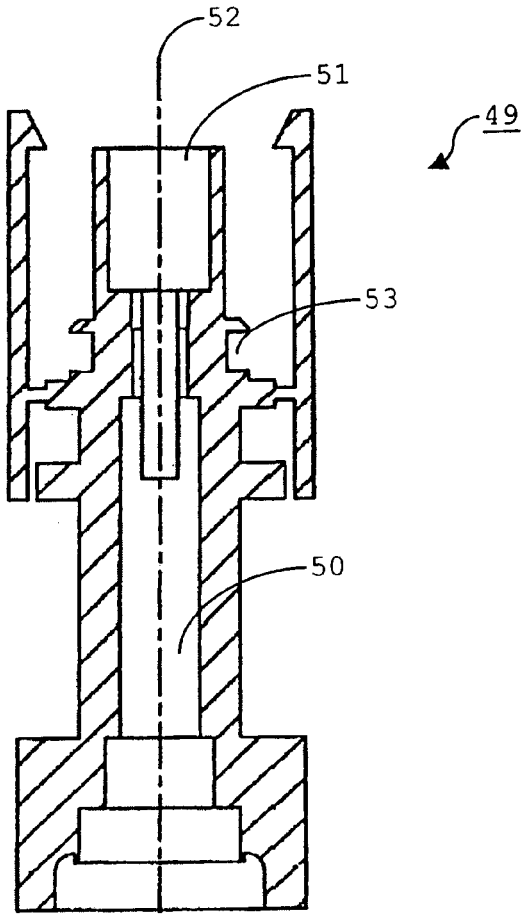
FIG. 9 is a cross-sectional side view of a connector housing for a mating connector, suitable for mating with either of the first and second embodiments of a connector housing assembly.

A mating connector housing 49 is shown in FIG. 9. A wire (not shown) is received in an elongated passage 50, which terminates in an enclosure 51 for accommodating a terminal of a male connector contact (not shown) attached to the wire. The male connector contact is adapted to mate with the connector contact 5 shown in FIG. 1. In a practical embodiment used in conjunction with solar foils, the wire has a cross-sectional area with a value in the range between 2.5 and 6 mm2. A single conducting core is made of copper or aluminium, surrounded by an insulating mantle made of a polyolefin or PTFE. The core has a diameter in the range of 2 3 mm. The wire has an outer diameter in the range of 5 6 mm. The rated voltage of the wire is, for example, 1000 V DC. In an example, the rated current is a value up to 60 A.

The mating connector housing 49 is suitable for engaging either the lower connector housing part 15 shown in FIG. 4 or the lower connector housing part 38 shown in FIG. 7. The configuration of the lower connector housing parts 15,38 and the mating connector housing 49 is such that a longitudinal axis 52 of the elongated passage 50 is substantially parallel to the longitudinal axis 32 or 46 respectively of the enclosures in which the terminal 5 is accommodated. Thus, it is ensured that the wire is also oriented transversely to the plane of the foil, preferably at right angles to it, when the assembly of the mating connector housing 49 and one of the illustrated connector housing assemblies attached to the foil is formed.

Latches 53 engage the barbs 33 or 47, respectively, when the mating connector housing engages the lower connector housing part 15 or 38, respectively. Latches 53 and barbs 33 or 47 form a locking mechanism providing pull relief to the wire in the elongated passage 50.

A circumferential groove 54 is provided to engage sealing means 56 (FIG. 10). The sealing means 56 ensure a substantially fluid-tight connection between the mating connector housing 49 and either of the lower connector housing parts 15, 38.

Practical embodiments of the illustrated upper and lower connector housing parts 11,34,15,38 are made of a polymer composite with good UV-resistance. The parts are made to withstand thermal cycling over a relatively large temperature range, for example between −40° C. and 85° C. Because the connector housing assemblies illustrated herein provide good shielding to the connector contact 5 and the area of the foil adjacent the connector contact 5, they can be applied directly to the foil. Additional sealing is not required. Furthermore, the shown connector housing assemblies are adapted for use in conjunction with solar foil that is adhered to a backing surface but not encased. This is in contrast to connector housing assemblies for solar arrays, wherein solar foil is accommodated in a (rigid) housing. Attachment of the connector is easy, because the shape of the piece of foil and the position of attachment of the connector are not strictly prescribed. Furthermore, because the protrusion 37 and pins 12,13 are integral parts of their respective connector housing parts, the number of parts is relatively low. This facilitates installation at remote locations.

The invention is not limited to the embodiments described above, which may be varied within the scope of the accompanying claims. For instance, although only embodiments with two protruding components for holding upper and lower connector housing parts together have been shown, there may be more protruding components. Each is inserted through a hole 54 in the foil held between the upper and lower connector housing parts. Holding means 55 can engage only a sub-set of the protruding components that are present.

The invention claimed is:

1. A connector housing assembly, comprising:

a foil;

an upper connector housing part; and a lower connector housing part, wherein when the foil, the upper connector housing part and the lower connector housing part are not attached to each other:

the foil, the upper connector housing part and the lower connector housing part are not in direct contact with each other, the upper connector housing part has a lower face that faces an upper surface of the foil, the lower connector housing part has an upper face that faces a lower surface of the foil, the lower face of the upper connector housing part or the upper face of the lower connector housing part defines a recess that opens and extends substantially, perpendicular to the lower face of the upper connector housing part or the upper face of the lower connector housing part and is configured to accept at least a part of a connector contact within the recess, at least one of the lower face of the upper connector housing part or the upper face of the lower connector housing part has at least one protruding component, and wherein when the foil, the upper connector housing part and the lower connector housing part are attached to each other:

the foil is located between the upper connector housing part and the lower connector housing part, each of the at least one protruding component is inserted through a respective hole in the foil, the upper connector housing part and the lower connector housing part are drawn to each other by the at least one protruding component with a holding means adapted to exert a retention force, and the holding means engages the at least one protruding component and abuts a surface of the upper connector housing part opposite the lower connector housing part or a surface of the lower connector housing part opposite the upper connector housing part.

2. The connector housing assembly according to claim 1, wherein the at least one protruding component is formed integrally with the upper connector housing part or the lower connector housing part.

3. The connector housing assembly according to claim 1, wherein the lower face of the upper connector housing part and the upper face of the lower connector housing part defines a recess that opens and extends substantially perpendicular to the lower face of the upper connector housing part or the upper face of the lower connector housing part and is configured to accept at least a part of a connector part within the recess.

4. The connector housing assembly according to claim 1, wherein:

the lower face or the upper face has a recess with an opening and is able to engage a sealing means surrounding the recess opening; and the sealing means is adapted to abut against the lower face of the upper connector housing part or the upper face of the lower connector housing part.

5. The connector housing assembly according to claim 1, wherein the upper connector housing part or the lower connector housing part has at least one opening to receive the protruding component, inserted through the hole in the foil, which draws the upper connector housing part and the lower connector housing part together by the at least one protruding component with the holding means adapted to exert the retention force.

6. The connector housing assembly according to claim 5, wherein an upper face of the upper connector housing part or a lower face of the lower connector housing part is substantially planar and parallel to a surface of the foil when the upper connector housing part or the lower connector housing part has been drawn sufficiently towards the foil.

7. The connector housing assembly according to claim 5, wherein a distance between the lower face and the upper face of the upper connector housing part or a distance between the upper face and the lower face of the lower connector housing part has a value smaller than two times a depth of the recess.

8. The connector housing assembly according to claim 1, wherein the upper connector housing part or the lower connector housing part comprising the recess further comprise a portion with an enclosure for accommodating a terminal of the connector contact, wherein:

the enclosure is open to the recess near one end of a longitudinal axis of the enclosure and the enclosure has an external access from a direction parallel to the longitudinal axis at an opposite end, and the longitudinal axis is orientated transversely to the lower face of the upper connector housing part or the upper face of the lower connector housing part.

9. The connector housing assembly according to claim 8, wherein the upper connector housing part or the lower connector housing part is adapted to engage a housing of a mating connector terminating a wire to be connected to a conducting lead embedded in the foil.

10. The connector housing assembly according to claim 9, further comprising a retention means for maintaining engagement with the housing of the mating connector.

11. The connector housing assembly according to claim 9, wherein the connector housing assembly comprises a housing for the mating connector.

12. A method of attaching a connector for use in connecting a wire to a conducting lead embedded in a piece of foil to the foil, the method comprising the steps of:

attaching to the foil a connector contact having a terminal for use in connecting a wire to the conducting lead, providing an upper connector housing part having a lower face that faces an upper surface of the foil and a lower connector housing part having an upper face that faces a lower surface of the foil, the lower face of the upper connector housing part or the upper face of the lower connector housing part defines a recess that opens and extends substantially perpendicular to the lower face of the upper connector housing part or the upper face of the lower connector housing part and is configured to accept at least a part of a connector contact within the recess, and at least one of the lower face of the upper connector housing part or the upper face of the lower connector housing part has at least one protruding component, inserting the at least one protruding component protruding from the lower face of the upper connector housing part or the upper face of the lower connector housing part through a respective hole in the foil, bringing the lower face of the upper connector housing part or the upper face of the lower connector housing part provided with the recess towards a facing surface of the foil, bringing the at least one inserted protruding component into engagement, on a side of the foil opposite the upper connector housing part or the lower connector housing part provided with the at least one inserted protruding component, with a holding means adapted to exert a retention force drawing the lower face of the upper connector housing part or the upper face of the lower connector housing part provided with the recess towards the facing surface of the foil such that the foil is located between the upper connector housing part and the lower connector housing part, and engaging the holding means with the at least one protruding component such that the engaging means abuts a surface of the upper connector housing part opposite the lower connector housing part or a surface of the lower connector housing part opposite the upper connector housing part.

13. A method according to claim 12, wherein the at least one protruding component is inserted through a hole in the conducting lead embedded in the piece of foil.

14. A method according to claim 12, further comprising the steps of:

providing the upper connector housing part or the lower connector housing part with at least one opening to receive the protruding component, and positioning the upper connector housing part or the lower connector housing part with the at least one opening over the conducting lead with a longitudinal axis of the upper connector housing part or the lower connector housing part with the at least one opening substantially in parallel to the conducting lead.

* * * * *